United States Patent [19]

Hanson

[11] Patent Number: 4,888,455

[45] Date of Patent: Dec. 19, 1989

[54] WATER LEAK DETECTOR AND METHOD THEREFOR

[76] Inventor: James B. Hanson, 4610 N. 68th St., #475, Scottsdale, Ariz. 85251

[21] Appl. No.: 316,484

[22] Filed: Feb. 27, 1989

[51] Int. Cl.[4] ..... H01H 29/00

[52] U.S. Cl. ..... 200/61.04

[58] Field of Search ..... 200/61.04–61.07; 340/602, 604, 605, 612, 618

[56] References Cited

U.S. PATENT DOCUMENTS

| | | | |
|---|---|---|---|
| 2,049,321 | 7/1936 | Sampson | 200/61.04 X |
| 2,443,687 | 6/1948 | Marquand | 200/61.04 |
| 3,200,388 | 8/1965 | Uhlig | 200/61.04 X |
| 3,311,721 | 3/1967 | Wright | 200/61.04 |
| 4,001,531 | 1/1977 | Crockett, Sr. | 200/61.04 |
| 4,193,068 | 3/1980 | Ziccardi | 200/61.04 X |

FOREIGN PATENT DOCUMENTS

| | | | |
|---|---|---|---|
| 286892 | 7/1968 | Australia | 200/61.04 |
| 3321314 | 12/1984 | Fed. Rep. of Germany | 200/61.04 |
| 380383 | 9/1932 | United Kingdom | 200/61.04 |

*Primary Examiner*—J. R. Scott

*Attorney, Agent, or Firm*—Harry M. Weiss

[57] ABSTRACT

In the absence of moisture, a separation between a pair of electrical contacts is maintained by a material that becomes frangible when moistened. When the material becomes moist, it breaks and the contacts close.

4 Claims, 1 Drawing Sheet

WATER LEAK DETECTOR AND METHOD THEREFOR

BACKGROUND OF THE INVENTION

1. Field of Invention

This invention relates generally to water sensors and more particularly to a spring loaded switch that is maintained in an open position by a water soluble substance or the like.

2. Description of the Prior Art

In an apartment building or a building of a condominium, it is commonplace to find a hot water heater in a residence on an upper floor. When there is water leak in the hot water heater, water may not only cause substantial damage to the upper floor residence but may leak through the ceiling of a residence on a lower floor. Hence, the lower floor residence may sustain substantial damage, such as a collapsed ceiling and water damage to rugs and furniture. A usual consequence of the water leak is that a person living in the upper floor residence has an undesirable exposure to liability for the damage caused to the lower floor residence.

In a single family dwelling, a homeowner's only warning of a water leak in his basement, for example, is awakening to find that there is several feet of water in the basement. The water may cause damage that may costs thousands of dollars to repair. Additionally, pumping the water out of the basement is difficult and expensive.

Although there are a plethora of devices that may be adapted to sense the water leak, these devices are typically expensive, unreliable and inconveniently large. Accordingly, there is a need for an inexpensive, reliable and small water leak detector.

SUMMARY OF THE INVENTION

An object of the present invention is an improved water leak detector.

Another object of the present invention is a water leak detector that is economical to construct.

According to the present invention, in the absence of moisture, a spring loaded switch has contacts that are maintained open by a material that becomes frangible when moistened. When the material becomes moist, it breaks and the contacts close.

A water leak detector of the present invention may be economically constructed by modifying a spring clip of a type that is readily available.

BRIEF DESCRIPTION OF THE DRAWING

FIG. 2(*b*) is a section view of the preferred embodiment wherein a pair of switch contacts are closed;

DESCRIPTION OF THE PREFERRED EMBODIMENT

The present invention is predicated upon a spring clip that has mounted thereon a pair of electrical contacts. In the absence of moisture, the contacts are maintained open by a material that becomes frangible when moistened. Accordingly, moisture causes the material to break, whereby the contacts close.

Figure 1:
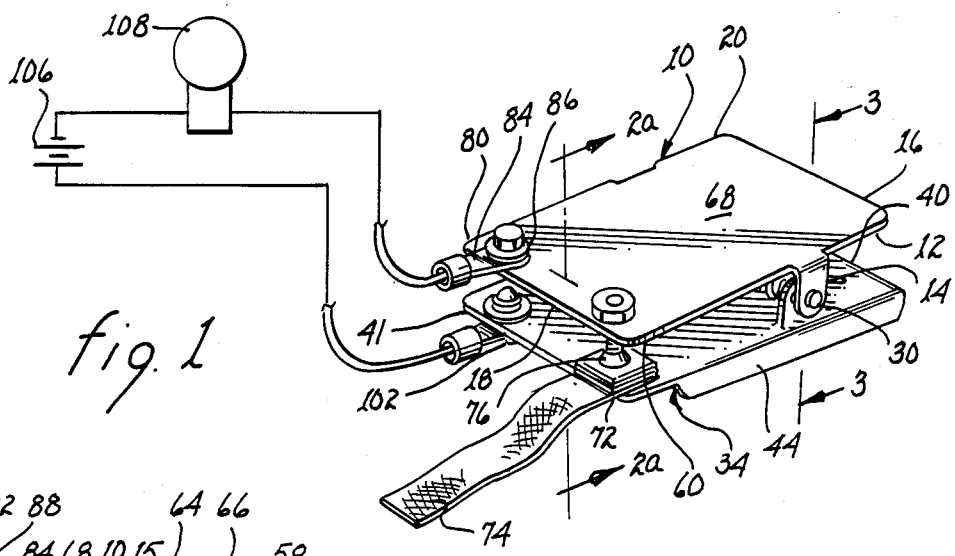
FIG. 1 is a perspective view of the preferred embodiment of the present invention.
Figure 2A:
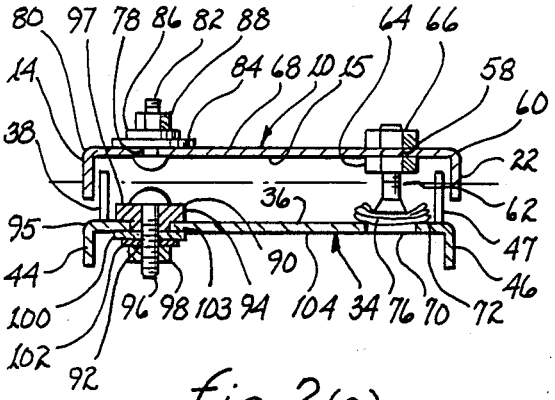
FIG. 2(*a*) is a view with parts broken away of the embodiment of FIG. 1 taken along the line 2*a*—2*a*.
Figure 3:
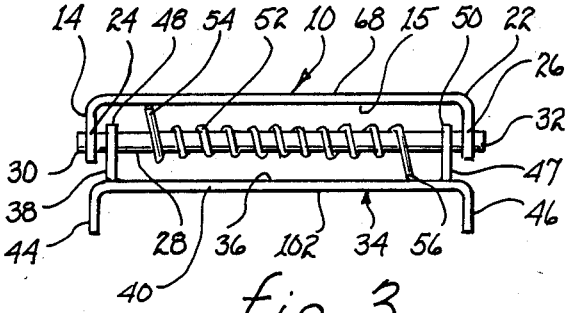
FIG. 3 is a view of the embodiment of FIG. 1 taken along the line 3—3.
Figure 2B:
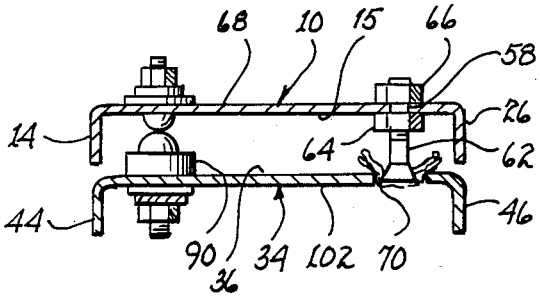

As shown in FIGS. 1–3, a rectangular top metal plate 10 includes a side edge 12 integrally connected to a tab shaped metal bushing 14 that is perpendicular to a bottom surface 15 (FIG. 3) of plate 10 and to a back edge 16 thereof. Bushing 14 is disposed about one third of the distance from edge 16 to a front edge 18 of plate 10.

Plate 10 additionally has a side edge 20, similar to edge 12, integrally connected to a tab shaped metal bushing 22 that is perpendicular to surface 15 and edge 16. Bushings 14, 22 are similar to each other. Like bushing 14, bushing 22 is disposed about one third of the distance from edge 16 to edge 18.

Bushings 14, 22 have opposed holes 24, 26 (FIG. 3) therethrough, respectively, wherein a cylindrical shaft 28 is carried. Hence, plate 10 is rotatably mounted on shaft 28 via bushings 14, 22. In this embodiment, shaft 28 has peened ends 30, 32 that maintain shaft 28 within holes 24, 26.

A rectangular bottom metal plate 34, similar in size to plate 10, includes a top surface 36 integrally connected to a tab shaped metal bushing 38 that is perpendicular to surface 36 and to a back edge 40 of plate 34. Bushing 38 is disposed about one third of the distance from edge 40 to a front edge 41 of plate 34.

Additionally, surface 36 is integrally connected to a tab shaped metal bushing 42, similar to bushing 38, that is perpendicular to surface 36 and edge 40 (FIG. 1). Like bushing 38, bushing 42 is disposed about one third of the distance from edge 40 to edge 41. In this embodiment, plate 34 is bent to form similar opposed sides 44, 46 that are perpendicular to surface 36.

The distance between bushings 38, 42 is less than the distance between bushings 14, 22. The spacing between bushing 38 and side 44 substantially equals the spacing between bushing 42 and side 46 (FIG. 3).

Bushings 38, 42 have opposed respective holes 48, 50 therethrough that are similar to holes 24, 26. Moreover, shaft 28 is carried within holes 48, 50, whereby holes 48, 50 are maintained in alignment with holes 24, 26 and plate 34 is rotatably mounted on shaft 28.

Figure 4:
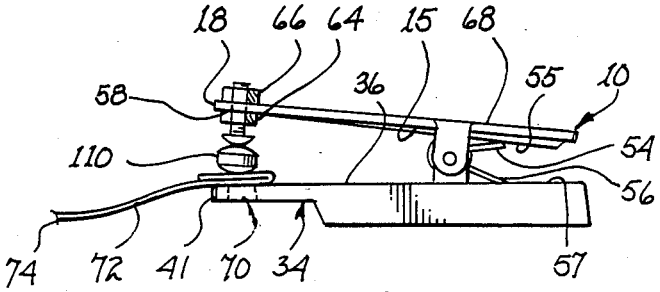
FIG. 4 is a side elevation of the embodiment of FIG. 1.

Shaft 28 is coaxial with a coil spring 52 that is disposed between bushings 38, 42. An end 54 of spring 52 is in contact with a distal portion 55 of surface 15 (FIG. 4). Similarly, an end 56 of spring 52 is in contact with a distal portion 57 of surface 36. Moreover, spring 52 is wound in compression, thereby pushing distal portions 55, 57 away from each other and correspondingly pushing edges 18, 41 towards each other, in a manner similar to ends of a spring in a spring clip.

Plate 10 has a hole 58 near a corner 60 thereof. A screw 62 has a threaded end maintained within hole 58 by nuts 64, 66 that are in an abutting relationship with surface 15 and a top surface 68 of plate 10, respectively.

As best shown in FIG. 2(*a*), within plate 34 is a hole 70 that is substantially aligned with hole 58. Hole 70 is occluded by folded water absorbent paper 72 of a type commonly used for paper towels. Paper 72 has an end 74 that extends away from plates 10, 34 (FIG. 1). The head of screw 62 is pressed against paper 72 because of the compression of spring 52 explained hereinbefore.

In this embodiment, sides 44, 46 rest on a floor near a hot water heater (not shown). Additionally, end 74 extends to the floor. When the floor becomes wet, capillary action causes all of paper 72 to become moist, and thereby become frangible.

As best shown in FIG. 2(*b*), when paper 72 becomes frangible it breaks, whereby the head of screw 62 is pressed through paper 72 by spring 52 into hole 70. As explained hereinafter, when the head of screw 62 is pressed through paper 72, there is a closure of a pair of contacts that may be utilized to energize an alarm of any suitable type.

Plate 10 has a hole 78 near a corner 80 thereof. A round head screw 82 has a threaded end that passes through hole 78. Screw 82 carries a lug 84 and a washer 86. Lug 84 is sandwiched between washer 86 and a top surface 68 of plate 10. A nut 88 is threadedly engaged with screw 82, thereby fastening lug 84, washer 86 and plate 10 together, with the head of screw 82 protruding from surface 15. Moreover, there is an electrically conductive path from lug 84 via plate 10, to the head of screw 82. As known in the art, washer 86 prevents a loosening of the threaded engagement of nut 88 due to vibration and ambient temperature changes.

Plate 34 has a hole 90 substantially aligned with hole 78. Within hole 90 is a bushing 92 made form any suitable electrically insulating material. Bushing 92 has a shoulder 94 with a bottom surface 95 in an abutting relationship with surface 36. Additionally, a round head screw 96 passes through bushing 92 with the shoulder of screw 96 in a abutting relationship with a top surface 97 of the shoulder of bushing 94.

Screw 96 carries a washer 100, made from an electrically insulating material, and a lug 102 similar to lug 84. Washer 100 is sandwiched between a bottom surface 104 of plate 34 and lug 102. A nut 98 is threadedly engage with screw 96, thereby fastening washer 100 and lug 102 to plate 34. Because of bushing 92 and washer 100, screw 96 and lug 102 are electrically insulated from plate 34.

It should be understood that when paper 72 occludes hole 70, the heads of screws 82, 96 do not contact each other. Conversely, when paper 72 breaks, the heads of screws 82, 96 are in contact. Accordingly, the heads of screws 82, 96 are screw contacts.

Lugs 84, 102 are connected in series with an electrical power source 106 and an alarm 108. Therefore, when paper 72 breaks, the alarm is energized.

As shown in FIG. 4, in an alternative embodiment, a water soluble tablet 110, such as an aspirin tablet, a sugar tablet or a salt tablet may be used in combination with water absorbent paper 72 to occlude hole 70. Tablet 108 becomes frangible when a substantial portion thereof is dissolved.

While the invention has been particularly shown and described with reference to a preferred embodiment thereof, it will be understood by those skilled in the art that changes in form and detail may be made therein without departing from the spirit and the scope of the invention.

I claim:

1. A water leak detector comprising:

a spring loaded switch comprising:

a pair of metal plates having a first electrical contact means for providing a first electrical contact mounted on a front edge of one of said pair of metal plates and having a second electrical contact means for providing a second electrical contact aligned with said first electrical contact means and mounted on a front edge of the other of said pair of metal plates, said first and second electrical contacts are normally open;

a spring and shaft means for rotatably securing and forcing said front edges of said pair of metal plates together comprising:

a cylindrical shaft upon which said pair of metal plates are mounted;

a compressed coil spring coaxially disposed on said shaft having a first end of said spring in contact with a first distal portion of a surface of one of said pair of metal plates and a second end of said spring in contact with a second distal portion of a surface of said other of said pair of metal plates, said first and second ends of said spring pushing said first and second distal portions away from each other and said front edges of said pair of metal plates towards each other; and means mounted on said front edges of said pair of metal plates opposite said first and second electrical contacts for maintaining a separation between said first and second electrical contacts of said switch in the absence of moisture said means for maintaining comprising a moisture responsive frangible material overlying one of said pair of metal plates, having a hole, the other of said metal plates having a puncturing means for puncturing said frangible material, said hole located in one of said pair of metal plates and aligned with said puncturing means mounted on said other of said pair of metal plates, said puncturing means punctures said frangible material when said frangible material becomes moistened.

2. The leak detector of claim 1 wherein said frangible material comprises a water absorbent paper.

3. The leak detector of claim 1 wherein said frangible material includes a tablet selected from the group consisting of aspirin, salt and sugar.

4. The leak detector of claim 2 wherein said frangible material includes a tablet selected from the group consisting of aspirin, salt and sugar.

* * * * *